US005822944A

United States Patent [19]

Penland, Sr.

[11] Patent Number: 5,822,944

[45] Date of Patent: Oct. 20, 1998

[54] DOUBLE LOCKING FLOORING SYSTEM FOR A CONSTRUCTION SITE

[76] Inventor: Joe E. Penland, Sr., P.O. Box 320, Nederland, Tex. 77627

[21] Appl. No.: 707,448

[22] Filed: Sep. 4, 1996

[51] Int. Cl.[6] ..... F04B 5/02; E01C 5/16

[52] U.S. Cl. ..... 52/591.1; 52/592.1; 52/581; 52/403.1; 52/745.03; 404/35; 404/41; 404/46

[58] Field of Search ..... 52/591.1, 592.1, 52/592.3, 177, 581, 584.1, 586.1, 313, 314, 403.1, 745.05, 745.03; 404/35, 40, 41, 46

[56] References Cited

U.S. PATENT DOCUMENTS

| | | | |
|---|---|---|---|
| 2,264,377 | 12/1941 | Hoffman | 20/4 |
| 2,306,520 | 12/1942 | Bunker et al. | 94/30 |
| 2,315,448 | 3/1943 | Nagin et al. | 94/4 |
| 2,335,556 | 11/1943 | Wilson | 94/13 |
| 2,652,753 | 9/1953 | Smith | 94/13 |
| 2,819,026 | 1/1958 | Leyendecker | 238/10 |
| 2,886,370 | 5/1959 | Liebert | 294/89 |
| 2,912,909 | 11/1959 | Hart | 94/11 |
| 3,990,197 | 11/1976 | Johnston | 52/125 |
| 4,001,988 | 1/1977 | Riefler | 52/125 |
| 4,289,420 | 9/1981 | Davis et al. | 404/35 |
| 4,462,712 | 7/1984 | Penland, Sr. | 404/36 |
| 4,538,392 | 9/1985 | Hamar et al. | 52/584.1 |
| 4,600,336 | 7/1986 | Waller, Jr. | 52/581 X |
| 4,875,800 | 10/1989 | Hicks | 404/35 |
| 4,889,444 | 12/1989 | Pouyer | 404/34 |
| 5,020,937 | 6/1991 | Pouyer | 404/35 |
| 5,058,349 | 10/1991 | Conrad | 52/581 X |
| 5,087,149 | 2/1992 | Waller, Jr. | 404/35 |
| 5,163,776 | 11/1992 | Pouyer | 404/35 |
| 5,273,373 | 12/1993 | Pouyer | 404/35 |
| 5,313,756 | 5/1994 | Ways et al. | 404/35 X |
| 5,316,408 | 5/1994 | Stanley et al. | 404/35 |

FOREIGN PATENT DOCUMENTS 414 124 12/1963 Switzerland .

*Primary Examiner*—Winnie S. Yip

[57] ABSTRACT

A method and apparatus for the construction of a two-layer flooring system for use at a construction site such as an oil well drilling site. The flooring system is particularly well suited for use in areas with dry, sandy soil. The flooring system is formed by interlocking both the ends and sides of a plurality of mat units. Each of the mat units includes two layers of boards. The first layer has end locking tabs extending beyond the edge of the first layer and corresponding end locking slots, formed by offsetting selected boards. The second layer similarly includes side locking tabs and corresponding side locking slots, also formed by offsetting selected boards. The arrangements of these tabs and slots is such that half-size units and inverted units may be utilized, allowing a wide variety of patterns of interlocking units to be utilized for the flooring system. The method of constructing a flooring system utilizing such units includes positioning one mat unit adjacent to other mat units and inserting the tabs into the corresponding slots to interlock the units. By interlocking a plurality of such units, a two-layer flooring system is fabricated at a construction site which is strong and sturdy enough to support heavy equipment, yet easily installed and removed.

12 Claims, 2 Drawing Sheets

DOUBLE LOCKING FLOORING SYSTEM FOR A CONSTRUCTION SITE

BACKGROUND OF THE INVENTION

1. Field of the Invention

The present invention relates generally to a construction site flooring system, and more particularly to a two-layer flooring system formed of a plurality of interlocking flooring units having end locking tabs and side locking tabs and corresponding slots such that the flooring units may be positioned and retained in place without additional fastening means or additional layers.

2. Description of the Prior Art

Oil field exploration and drilling operations are often undertaken in geographic areas that are, in their natural state, inaccessible to vehicles and equipment necessary for such exploration. These areas include swamps, marshlands, riverbeds, snow covered regions, and areas with soft or sandy soil. In order to explore for oil in such areas, it is necessary to locate heavy drilling rigs, vehicles and other equipment for some period of time on or adjacent to the location where the well is to be drilled. In order to transport this heavy equipment to the site and to support the equipment at the site, the industry has utilized for many years temporary roads leading to and from the site and flooring systems or pads at the particular site.

The prior art systems have been designed primarily for swampy or marsh-like areas where the natural support of the ground is inadequate for the equipment. Sometimes, such support systems are manually built at the construction site by placing a layer of individual wooden boards on the ground, adding a second layer of individual boards placed perpendicular to the first layer, and attaching the two layers together using nails or other fasteners. This layering process is repeated until the flooring system was sufficiently strong, usually requiring three or more layers for most areas.

After drilling operations are complete, the boards must be manually removed. These systems thus require large amounts of time and manual labor to install and remove. Additionally, individual boards are often damaged during removal such that they are unsuitable for reuse.

Recently, a number of flooring systems have been developed which utilize prefabricated mats or flooring units. These prefabricated units generally consist of multiple layers of boards, and are arranged and installed at the construction site to form the flooring system. Penland, U.S. Pat. No. 4,462,712, hereby incorporated by reference, discloses such a flooring system, using interlocking flooring units and a third, covering layer.

Because these systems are designed for areas where ground support is inadequate, the prior art systems often require the use of at least three layers of boards, and/or manually connecting the units at the construction site to ensure structural integrity.

Drilling operations which take place in other areas such as dry, sandy areas often require less support than those operations which take place in wet, swampy areas. In many dry, sandy areas, the support from the ground would be sufficient to support the weight of the vehicles and equipment, but the loose sandy condition of the soil precludes operation of the vehicles and equipment directly on the soil. In such areas, a flooring system consisting of two layers of boards may be sufficient to support drilling operations. However, because the prior art systems require either the use of three layers of boards or manual on-site fastening of individual pieces for the units to fully interlock, unnecessary labor and/or material must be used in constructing these systems when used in such dry, sandy areas.

As a result of the shortcomings of the prior art, typified by the systems described above, there has developed and continues to exist a substantial need for a two-layer flooring system which can be easily and economically installed at a construction site such as an oil well drilling site. Despite this need, such a flooring system has heretofore been unavailable.

SUMMARY OF THE INVENTION

It is, therefore, a feature of the present invention to provide a two-layer flooring system to be installed at a construction site which is economical to install and which has fully interlocking units.

It is another feature of this invention that the system may be installed with minimum need for manual, on-site connection of the individual units.

A still further feature of the present system is that individual units which are one-half the size of the other mat units, and inverted mat units oriented perpendicularly to the other mat units may be utilized to facilitate placing the mats in an offset pattern and to obtain a proper fit, such as around the edges of the flooring system.

An additional feature of the present invention is that the two-layer system is lighter and easier to install and remove at the construction site.

Finally, a feature of the invention is the installation of a flooring system with an arrangement of locking tabs and locking slots that requires the installer to align the mat units correctly.

The present invention is advantageous over the prior art in that the same consists of only two layers of boards and typically requires minimal or no manual fastening of pieces together at the site, yet allows complete interlocking of the individual units and provides sufficient structural support for vehicles and equipment traveling over dry, sandy terrain.

The present invention is summarized in that a flooring system for use at a construction site or as a roadway is formed from a series of interlocking mat units formed from a plurality of wooden boards. Each mat unit may be constructed of only two layers of boards, including a first layer formed of a plurality of parallel boards of substantially uniform length and having a plurality of end locking tabs on one end and end locking slots on the other end. These end tabs and slots are formed by longitudinally offsetting selected boards of the top layer. A second layer formed of a plurality of parallel boards of substantially uniform length is connected substantially perpendicular and underlying the boards of the first layer with the sides and ends of the second layer aligned with the corresponding sides and ends of the first layer. The second layer has a plurality of side locking tabs extending from one side and a plurality of side locking slots on the other side. These side tabs and side slots are formed by longitudinally offsetting selected boards of the second layer. The end locking tabs and side locking tabs of the first mat unit may be vertically positioned into the end locking slots and side locking slots of adjacent mat units to interlock and form a portion of the flooring system.

So that the manner in which the above-recited advantages and features of the present invention, as well as other which will become apparent, are attained and can be understood in detail, a more particular description of the invention, briefly summarized above, may be had by reference to the embodiments there which are illustrated in the appended drawings, which drawings form a part of this specification.

It is to be noted, however, that the appended drawings illustrate only a typical embodiment of the invention and are, therefore, not to be considered limiting of its scope, for the invention may admit of other equally-effective embodiments.

DESCRIPTION OF THE PREFERRED EMBODIMENTS

Figure 1:
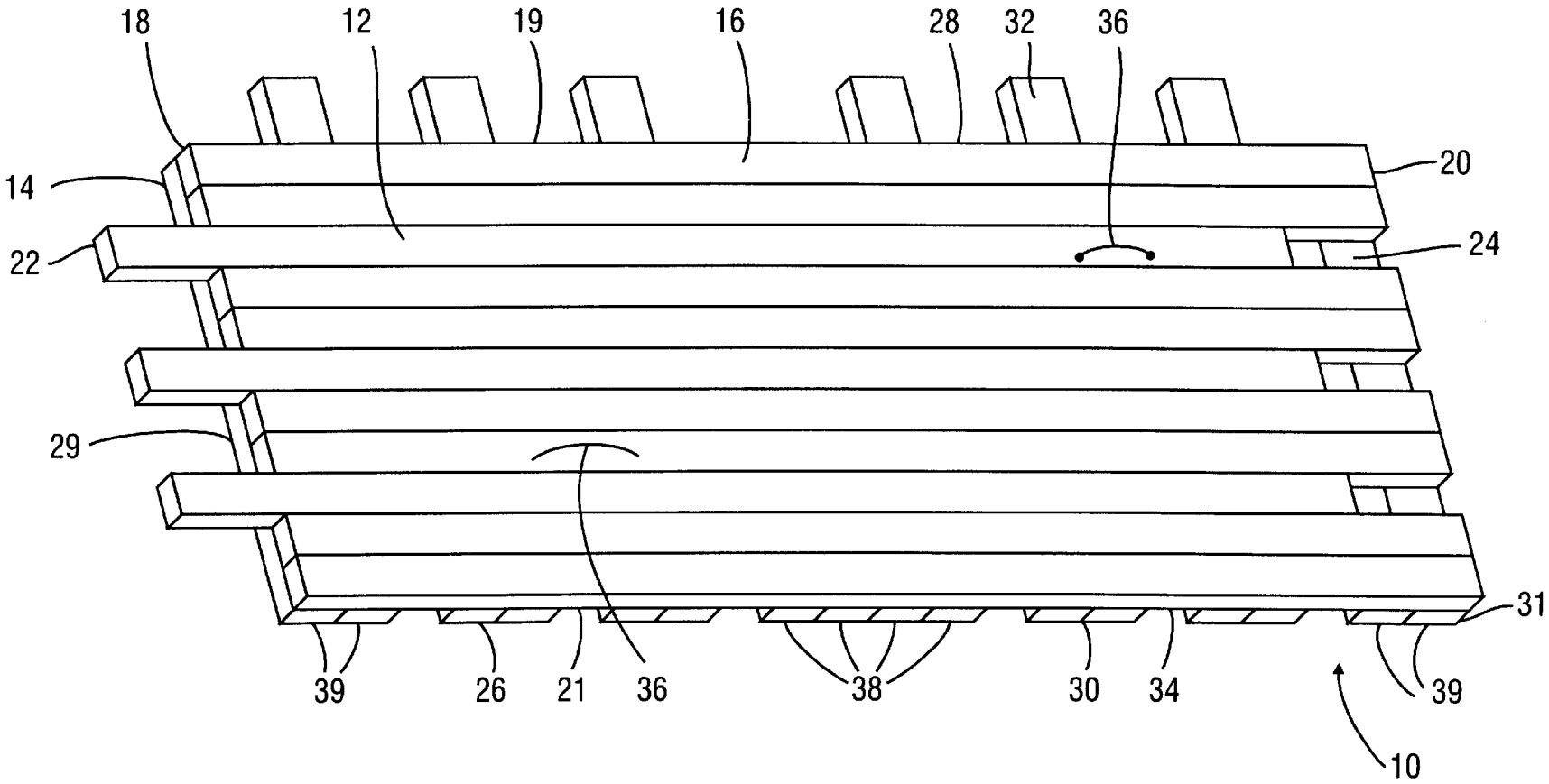
FIG. 1 is a perspective view of a mat unit built according to the present invention.

Referring first to FIG. 1, an individual mat unit of the present invention is shown and described. The mat unit 10 includes a first layer 12 with a second layer 14 attached to and underlying the first layer as shown in FIG. 1.

The first layer 12 is formed of a plurality of parallel wooden boards 16 of substantially uniform length. Each board 16 is positioned parallel to an adjacent board to form a flat first layer. First layer 12 includes a first end 18 and a second end 20, and a first side 19 and a second side 21. Selected boards of layer 12 are longitudinally offset such that they extend beyond the first end 18 of the first layer 12, forming end locking tabs 22 which extend beyond first end 18 of first layer 12, and end locking slots 24, which are recessed from second end 20 of first layer 12. Each locking tab 22 thus formed is aligned with a corresponding end locking slot 24. The embodiment of FIG. 1 discloses three such end locking tabs 22 and three corresponding end locking slots 24, such tabs and slots being equally spaced along the respective ends of the first layer 12 by offsetting every third board 16 from the first side 19 of the first layer 12. It will be apparent, however, that various other arrangements of end locking tabs and corresponding end locking slots as described here could readily be substituted for the arrangement herein.

Underlying first layer 12 is second layer 14 which may also be formed of a plurality of parallel boards 26 of substantially uniform length. Each second layer board 26 is attached to the overlying first layer boards 16 by means of any conventional connection means such as nails, a nut and bolt assembly, or a gluing compound. The second layer boards 26 are aligned with one another to form a series of parallel boards connected substantially perpendicular to the boards 16 of the first layer 12. The second layer 14 includes a first side 28 and a second side 30, and a first end 29 and a second end 31. The two layers are aligned such that the first end 18 and second end 20 of the first layer 12 are aligned with the first end 29 and the second end 31 of the second layer 14, respectively. Likewise, the first side 19 and second side 21 of the first layer 12 are aligned with the first side 28 and second side 30 of the second layer 14, respectively. Selected boards 26 of the second layer 14 are offset such that they extend beyond the first side 28 of the second layer 14, forming side locking tabs 32 which extend beyond the first side 28 of second layer 14, and side locking slots 34 which are recessed from second side 30 of second layer 14. Each side locking tab 32 thus formed is aligned with a corresponding side locking slot 34. The embodiment of FIG. 1 discloses six such side locking tabs 32 and six corresponding side locking slots 34. In this embodiment, the tabs and slots are not equally spaced along the respective sides of the second layer 14. Rather, the selected boards 26 which are offset to form the side locking tabs 32 and side locking slots 34 are the third, sixth, and ninth boards from the first end 29 of the second layer 14, and the third, sixth, and ninth boards from the second end 31 of the second layer 14.

The second layer 14 of the embodiment of FIG. 1 includes a plurality of center boards 38 in the central portion of second layer 14. Center boards 38 are not used to form tabs and slots and, therefore, are not offset. In the embodiment of FIG. 1, four center boards 38 are used. At each end 29, 31 of second layer 14, a pair of edge boards 39 are provided which also are not used to form tabs and slots and not offset. As can be understood, by not offsetting center boards 38 and edge boards 39, the mat units 10 present a side locking tab pattern that requires the units to be fully aligned along the side or offset by an amount of one-half a unit. This side tab arrangement also allows the effective use of half units and inverted units as will be more fully explained.

Referring still to FIG. 1, each of the mat units 10 is provided with at least one lifting attachment 36 for attaching a lifting line or other device to lift and position the mat units. In the embodiment of FIG. 1, this attachment takes the form of flexible attachment loops which are connected to the first layer 12. These lifting attachments 36 do not provide any substantial obstacle to the use of the flooring system after installation since they are easily flattened by any vehicle which passes over them.

Figure 2:
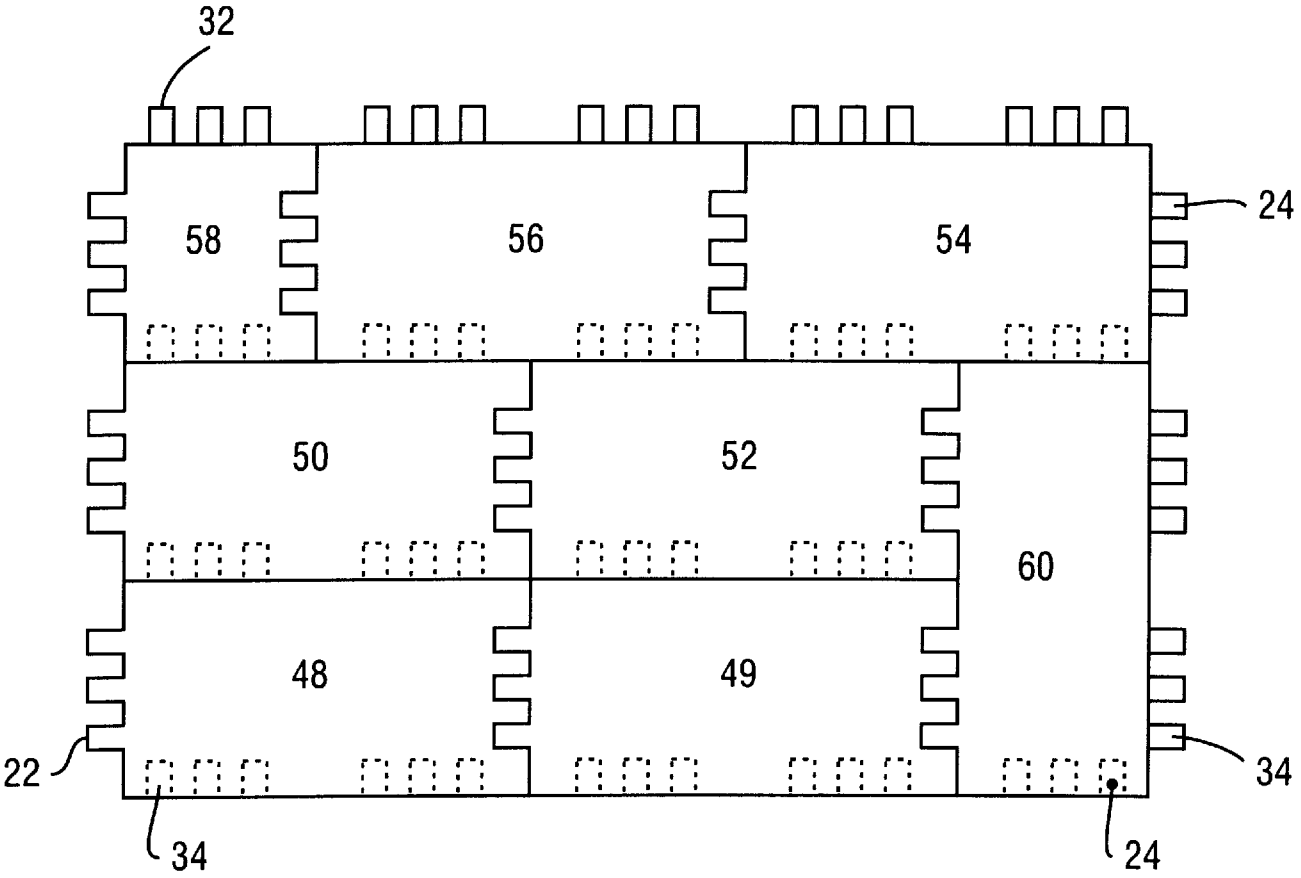
FIG. 2 is a plan view of the flooring system of the present invention as installed using a series of the mat units shown in FIG. 1.

Referring now to FIGS. 1 and 2 (for clarity, individual boards are not shown in FIG. 2), it is seen that if the number of center boards 38 used is twice as large as the number of edge boards 39, it is possible to limit possible positioning of the units yet have effective construction with only two lengths of units. With this side tab and slot arrangement, the mat units 10 may be placed parallel, side by side to one another to form rows and columns such as shown in FIG. 2, units 48, 49, 50, 52. This alignment is possible since center boards 38 are aligned. Alternatively, the mat units 10 may be longitudinally offset by an amount equal to one-half the length of a unit 10 so that the units are somewhat more interlocked. Units 50, 52, 54, 56 are arranged in this offset manner. This offset pattern is possible since the center boards 38 are positioned such that they are aligned with the edge boards 39 of two units which together form a space between tabs equal to the space formed by center boards 38.

Also seen in FIG. 2 is half unit 58. Half unit 58 also uses a pair of edge boards 39, but does not use center boards 38. Half unit 58 is formed such that its longitudinal length is about one-half the length of the regular mat unit 10. Half unit 58 may be constructed using boards for the first layer 12 which are about one-half the length of boards 16 of the regular mat units 10, and by using one-half as many second layer boards 26 as the regular mat units 10. Half units 58 allow the user to complete rows of units such as shown in FIG. 2 or arrange the units to accommodate areas where the regular mat units 10 are too long such as at edges or ends of the construction site.

Also seen in FIG. 2 is inverted unit 60. Inverted unit 60 is a mat unit 10 which has been inverted such that the second layer 14 is on top. In the present embodiment, the arrangement of end locking tabs 22 of the mat unit 10 is the same as the arrangement of one half of the side locking tabs 32. Thus, as shown in FIG. 2, when a mat unit 10 is inverted to form inverted unit 60, inverted unit 60 may be oriented perpendicularly to the regular mat units, such that the side locking tabs 32 of inverted unit 60 fit into the end locking slots 24 of mat units 49 and 52, and the end locking tabs 22 of inverted unit 60 fit into three of the side locking slots 34 of mat unit 54. Inverted unit 60 may be provided with lifting attachment 36 attached to second layer 14 instead of or in addition to first layer 12. Alternatively, selected mat units 10 may be provided with lifting attachments 36 attached to both the first and second layer, so that the mat unit 10 may be utilized as either regular mat unit 10 or inverted unit 60.

METHOD OF INSTALLATION

Referring in particular to FIG. 2, a method for constructing a flooring system to be used at a construction site is disclosed. It is contemplated that during the installation of such a flooring system a fork lift, crane or other lifting equipment is available at the site. A fork lift would directly engage each unit and place it in the proper position. If a crane is available, it typically includes a lifting line which may be attached to the individual flooring units for unloading such units from the vehicle which transported the units to the construction site. However, the lifting, aligning, and lowering operations discussed below may also be performed by any suitable mechanical device.

The method contemplated for installing such a system includes providing a plurality of the mat units 10 as previously described. Each of these mat units 10, of course, would have a plurality of end locking tabs 22, a plurality of end locking slots 24, a plurality of side locking tabs 32, and a plurality of side locking slots 34. Referring to FIG. 2, six such units, 48, 49, 50, 52, 54, and 56, are shown, as well as half unit 58 and inverted unit 60. Once mat unit 48 is property positioned on the drilling site, mat unit 49 is vertically positioned such that end locking tabs 22 of mat unit 49 are aligned with end locking slots 24 of mat unit 48. Mat unit 49 is then lowered into position, thus interlocking the end of mat unit 49 to the end of mat unit 48. It may be necessary to manually shift each mat a few inches by hand to precisely position the mat.

Next, mat unit 50 is vertically positioned such that side locking slots 34 of mat unit 50 are aligned with side locking tabs 32 of mat unit 48. Mat unit 50 is then lowered into position, thus interlocking the side of mat unit 50 to the side of mat unit 48. Mat unit 52 is next vertically positioned such that end locking tabs 22 of mat unit 52 are aligned with end locking slots 24 of mat unit 50, and side locking slots 34 of mat unit 52 are aligned with side locking tabs 32 of mat unit 49. Mat unit 52 is then lowered into place, thus interlocking the end of mat unit 52 to the end of mat unit 50 and the side of mat unit 52 to the side of mat unit 49. Under most normal situations when the subject units are used in suitable conditions, additional fastening means such as nails are not needed to secure one unit to another. However, it may be necessary to use some fastening means in selected locations to secure the units in position until the underlying soil conforms to the underside of the unit. Such fastening means may be nails placed through selected tabs to "tack" the units in place.

FIG. 2 also shows the use of half unit 58 to longitudinally offset mat units 56 and 54 in relation to mat units 50 and 52, as previously described. Half unit 58 is vertically positioned such that side locking slots 34 of half unit 58 are aligned with three of the side locking tabs 32 of mat unit 50. Half unit 58 is then lowered into position, thus interlocking the side of half unit 58 to one half of the side of mat unit 50. Next, mat unit 56 is vertically positioned such that end locking tabs 22 of mat unit 56 are aligned with end locking slots 24 of half unit 58, and side locking slots 34 of mat unit 56 are aligned with three side locking tabs 32 of mat unit 50 and three side locking tabs 32 of mat unit 52. Mat unit 56 is then lowered into position, thus interlocking the end of mat unit 56 to the end of half unit 58 and the side of mat unit 56 with one half of the side of mat unit 50 and one half of the side of mat unit 52.

Mat unit 54 may then be vertically positioned such that end locking tabs 22 of mat unit 54 are aligned with end locking slots 24 of mat unit 56, and three of the side locking slots 34 of mat unit 54 are aligned with three of the side locking tabs 32 of mat unit 52. Mat unit 54 is then lowered into place, thus interlocking the end of mat unit 54 with the end of mat unit 56, and interlocking one half of the side of mat unit 54 with one half of the side of mat unit 52. These steps may be repeated with additional mat units, in either a parallel, side-by-side arrangement of rows and columns such as in units 48, 49, 50, and 52, or in an offset arrangement typified by units 50, 52, 54, and 56, or in a combination of these two arrangements. Completion of the flooring system in this manner results in each mat unit being interlocked with adjacent mat units on at least one end and at least one side.

The method of installation shown in FIG. 2 may also include the use of inverted units 60, previously described. By simply turning a regular mat unit 10 over to form inverted unit 60, in which second layer 14 is the top layer, added flexibility in installing the flooring system is provided. When performing the method using inverted unit 60 as shown in FIG. 2, inverted unit 60 should preferably be installed prior to installation of mat unit 54. After mat units 48, 49, 50, 52, and 56 and half unit 58 are in place as described above, inverted unit 60 may be vertically positioned such that side locking tabs 32 of inverted unit 60 are aligned with end locking slots 24 of mat units 49 and 52. Inverted unit 60 may then be lowered into place, thus interlocking the side of inverted unit 60 with the ends of both mat unit 49 and mat unit 52. Mat unit 54 may next be vertically positioned such that end locking tabs 22 of mat unit 54 are aligned with end locking slots 24 of mat unit 56, three of the side locking slots 34 of mat unit 54 are aligned with three of the side locking tabs 32 of mat unit 52, and the remaining three side locking slots 34 of mat unit 54 are aligned with end locking tabs 22 of inverted unit 60. Mat unit 54 may then be lowered into position, thus interlocking the end of mat unit 54 with the end of mat unit 56 and the side of mat unit 54 with both one half of the side of mat unit 52 and the end of inverted unit 60. As can be readily appreciated, a multitude of different patterns may be formed by varying the manner in which regular mat units, such as 48, 49, 50, 52, 54, and 56, half units 58, and inverted units 60 are arranged.

Referring back to FIG. 1, the mat units typically may be constructed of hardwood boards 8" wide by 2" thick. Although applicant has referred to the parallel members of the mat units as boards, this term should be considered in its broad sense and include any elongated member made of wood or other suitable material. It can, therefore, be appreciated that the method and apparatus for constructing a flooring system at a construction site according to the present invention exhibits numerous advantages in construction, operation, and installation while providing a two-layer flooring system with sufficient strength to meet the needs of the industry in some geographic locations. The various embodiments and modifications according to this invention facilitate the low cost transportation, construction, use and removal of a flooring system for use at such construction sites.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, parts may be reversed, and certain features of the invention may be utilized independently of use of other features, all as would be apparent to one skilled in the art after having the benefit of this description of the invention.

What is claimed is:

1. A flooring mat unit to be interlocked with a plurality of other such units to form a flooring system for use as a construction site or roadway, each unit formed from only two-layers of interconnected wooden boards and vertically positionable to form a completed two-layer flooring system without the addition of individual boards for tie-in purposes, each mat unit comprising:

a first layer having a first end and an opposed second end and a first and second side and formed of a plurality of substantially parallel boards of substantially uniform length, the first layer having a plurality of end locking tabs projecting from the first end, the opposed second end of the first layer having a plurality of end locking slots aligned with said end locking tabs, said end tabs and slots formed by longitudinally offsetting selected boards of the first layer; and a second layer having a first side and an opposed second side and a first and second end and formed of a plurality of substantially parallel wooden boards of substantially uniform length attached substantially perpendicular and underlying the boards of the first layer with the ends and sides of the second layer aligned with the corresponding sides and ends of the first layer, the second layer having a plurality of side locking tabs extending from one side of the second layer and the opposed side of the second layer having a plurality of aligned side locking slots, said side tabs and side slots formed by longitudinally offsetting selected boards of the second layer;

whereby the end locking tabs and side locking tabs of a first mat unit are vertically placed into end locking slots and side locking slots of adjacent mat units to form an interlocked portion of the completed two-layer flooring system without the addition of individual boards for tie-in purposes.

2. The flooring mat unit of claim 1, wherein the selected boards of the first layer are not adjacent to one another.

3. The flooring mat unit of claim 1, wherein the selected boards of each mat unit are every third board from a single side of the first layer, and the third, sixth, and ninth boards from each end of the second layer.

4. The flooring mat unit of claim 1, wherein the second layer of each mat unit includes at least one edge board at each end and at least a pair of center boards, said side tabs and slots formed by offsetting boards of the second layer other than said edge boards and center boards.

5. The flooring mat unit of claim 4, wherein the number of second layer center boards of each mat unit is twice the number of second layer edge boards at each end of said second layer.

6. The flooring mat unit of claim 1, wherein each mat unit includes a lifting attachment such that a lifting line may be removably attached to the unit and the unit may be vertically lowered into position in the system with the use of a lifting device such as a crane.

7. A flooring system formed by interlocking a plurality of the mat units of claim 1, wherein the system also includes at least one half unit having a first layer formed from boards having a length which is approximately one-half the length of the boards forming the first layer of the mat units.

8. The flooring system of claim 7, wherein the number of boards used to form the second layer of the half unit is one-half the number of boards forming the second layer of the mat units.

9. A flooring system formed by interlocking a plurality of the mat units of claim 1, wherein selected mat units are inverted units and whereby the end locking tabs of the inverted units may be vertically positioned into the side locking slots of adjacent mat units and the side locking tabs of the inverted units may be vertically positioned into the end locking slots of adjacent mat units.

10. A method for constructing a completed two-layer flooring system from a plurality of interlocking mat units without the addition of individual boards for tie-in purposes, the system to be used at a construction site or roadway, the method comprising the steps of:

providing a plurality of interlocking mat units, each mat unit constructed of only two-layers of interconnected wooden boards and having two ends and two sides, each mat unit comprising a first layer of substantially parallel boards, the first layer having a plurality of end locking tabs and a corresponding plurality of opposed, aligned end locking slots, and a second layer of substantially parallel boards attached substantially perpendicular and underlying the boards of the first layer, said second layer having a plurality of side locking tabs and a corresponding plurality of opposed, aligned side locking slots;

vertically placing a first mat unit with respect to a second mat unit;

lowering the first unit with respect to the second unit such that a plurality of the end locking tabs or side locking tabs of one of the first or second mat units are engaged in a plurality of end locking slots or side locking slots of the other of said first or second mat units, thus interlocking at least a portion of said first mat unit to said second mat unit; and repeating the steps of vertically placing and lowering using additional mat units, whereby each additional mat unit is at least partially interlocked on at least one end or side to previously lowered adjacent mat units to form the completed two-layer flooring system without the addition of individual boards used for tie-in purposes.

11. The method of claim 10, wherein the step of providing interlocking mat units includes providing half units.

12. The method of claim 10, wherein the step of providing interlocking mat units includes providing inverted units.

* * * * *